US006609278B1

(12) United States Patent
Ritter et al.

(10) Patent No.: US 6,609,278 B1
(45) Date of Patent: Aug. 26, 2003

(54) YARN PROCESSING DEVICE AND USE THEREOF

(75) Inventors: Helmut Ritter, Wattwil (CH); Patrick Buchmüller, Krummenau (CH); Gotthilf Bertsch, Ebnat-Kappel (CH); Erwin Schwarz, Ulisbach (CH)

(73) Assignee: Heberlein Fibertechnology, Inc., Wattwill (CH)

( * ) Notice: Subject to any disclaimer, the term of this patent is extended or adjusted under 35 U.S.C. 154(b) by 0 days.

(21) Appl. No.: 09/623,396

(22) PCT Filed: Mar. 3, 1999

(86) PCT No.: PCT/CH99/00097

§ 371 (c)(1),
(2), (4) Date: Nov. 17, 2000

(87) PCT Pub. No.: WO99/45185

PCT Pub. Date: Sep. 10, 1999

(30) Foreign Application Priority Data

Mar. 3, 1998 (CH) ..... 499/98

(51) Int. Cl.[7] ..... D02J 1/08; D01H 1/14
(52) U.S. Cl. ..... 28/271; 28/274; 57/350
(58) Field of Search ..... 28/219, 220, 247, 28/258, 262, 263, 271, 272, 273, 274, 276, 281, 282, 283; 57/282, 284, 22, 23, 289, 332, 333, 350, 351, 908; 34/618, 623, 629, 631, 634, 636, 638, 639; 68/200, 175; 264/177.13, 210.8, 211.14, 211.17, 211.22

(56) References Cited

U.S. PATENT DOCUMENTS 3,261,071 A * 7/1966 Clendening, Jr. et al. ..... 28/271
3,381,458 A * 5/1968 Rajnoha et al. ..... 57/1 R
3,638,291 A * 2/1972 Yngve ..... 28/273
3,822,538 A * 7/1974 Cardell ..... 57/22
5,325,572 A * 7/1994 Dickson et al. ..... 28/274
5,857,249 A * 1/1999 Todd ..... 28/276

FOREIGN PATENT DOCUMENTS

| | | |
|---|---|---|
| DE | 28 33 905 | 2/1979 |
| EP | 0 114 298 | 8/1984 |
| GB | 1 557 007 | 12/1979 |
| WO | WO 97/30200 | 8/1997 |

* cited by examiner

*Primary Examiner*—Amy B. Vanatta
(74) *Attorney, Agent, or Firm*—Finnegan, Henderson, Farabow, Garrett & Dunner L.L.P.

(57) ABSTRACT

The invention relates to a pin assembly which keeps single-piece, two-piece or multi-pieced yarn processing elements, especially yarn interlacing spinnerets or thermal treatment elements, in an exact position during an entire service life, despite the extreme effects of preparations used. Instead of a traditional soldered joint or an adhesive connection, mechanical clamping means are used to fix the dowel pins to one part of the spinneret. Fixation of the dowel pins is not affected by heat or chemical preparations. The clamping means consists of a simple clamping ring holding the dowel pin in position directly inside the body of the spinneret between the clamping pin and an after-body. The novel positioning solution can be used with individual parts of spinnerets, parts of spinnerets in machines or multiple parts of spinnerets. The dowel pins enable the entire spinneret to be substantially miniaturized and allow narrow separation between various yarn runs, which was previously impossible. The invention can be used advantageously in interlacing spinnerets or in stream treatment elements.

32 Claims, 5 Drawing Sheets

Figure 1A:
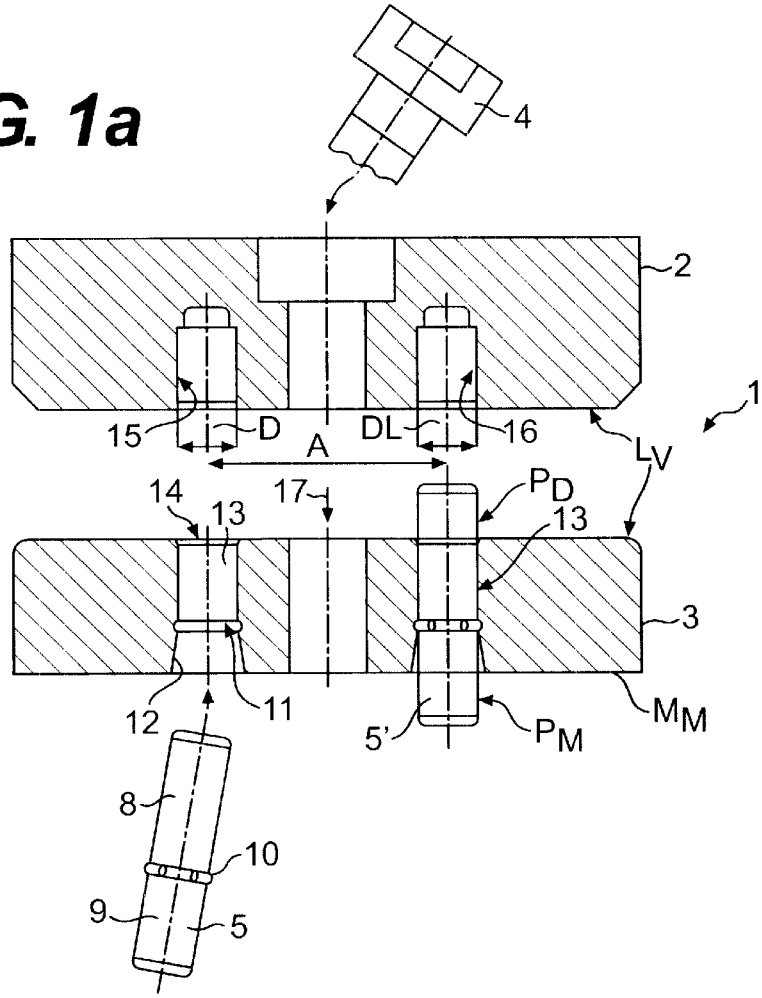

FIG. 6
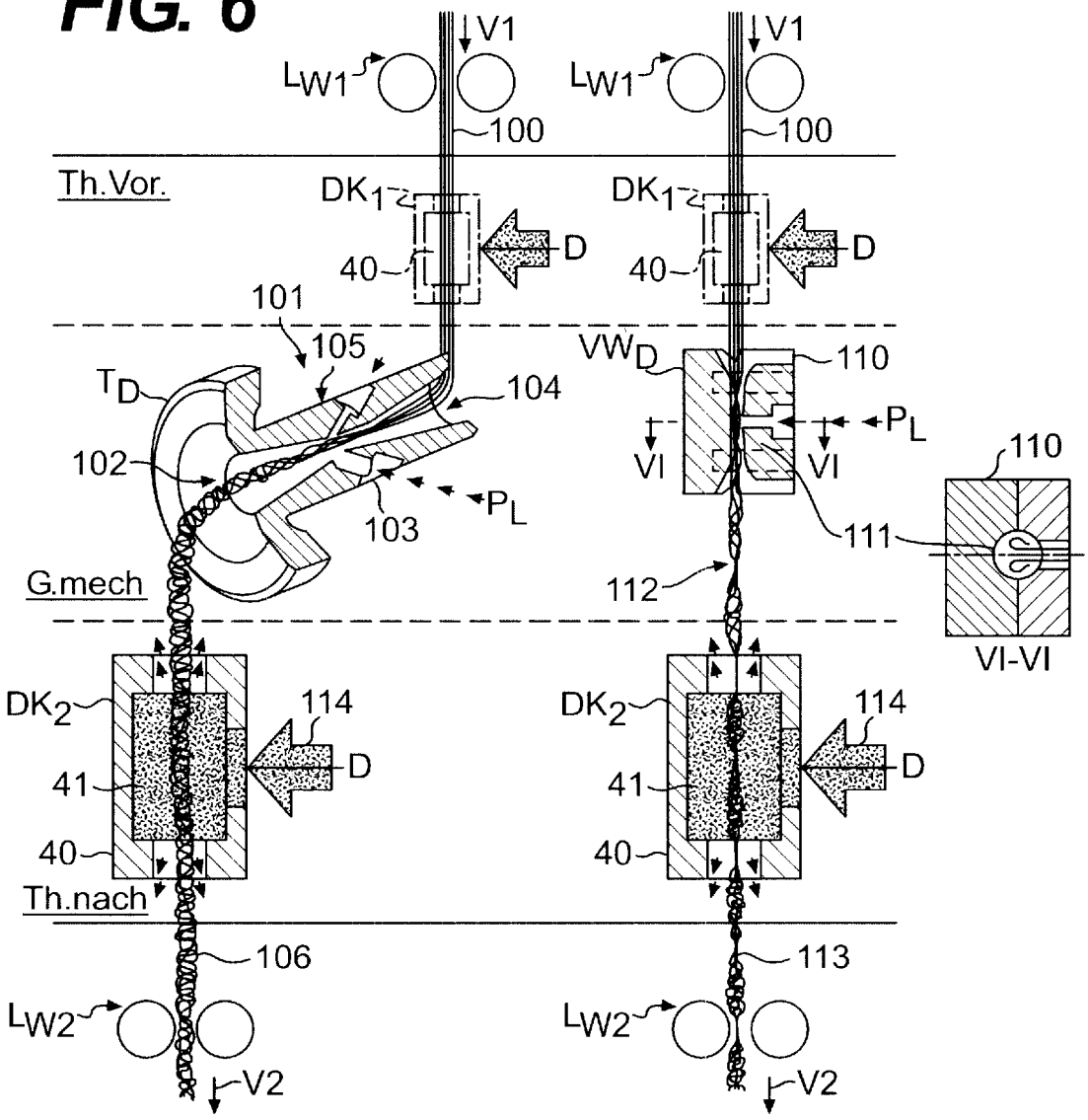
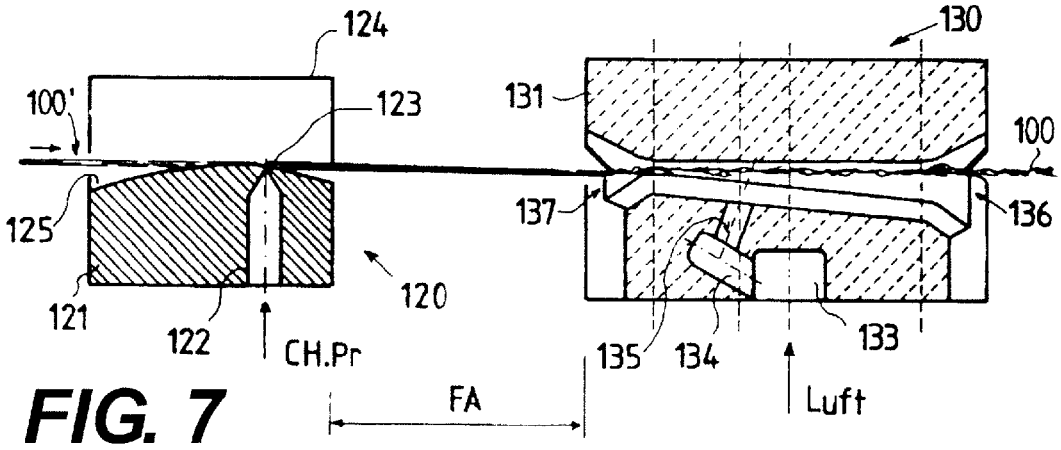
FIG. 7

YARN PROCESSING DEVICE AND USE THEREOF

TECHNICAL FIELD

The invention relates to a yarn processing device fitted with a preferably separable screw connection of two processing elements made of highly wear-resistant material, especially ceramics, and the use thereof.

STATE OF THE ART

The processing of filament yarn has to achieve essentially two tasks. On the one hand the yarn made of industrially produced filaments is to be given a textile character and textile engineering properties. On the other, the yarn is processed with a view to specific quality features required for further processing and/or for the final product in some cases yarn qualities will be required which are not necessary with products made of natural fibers and—what is more—these cannot even be realized. The fields of application are within the industrial processing of textiles e.g. for the construction sector, automotive production but also for the manufacture of carpets and for specific textile products the sports and leisure industry offers. Moreover, spun yarn is to be treated by certain preparations to facilitate an optimal industrial processing, and the processing procedure for yarns and surface formations is to be optimized. Optimization in this context includes preservation and improvement of certain quality criteria and reduction of production costs which is to include downtimes during the entire span of processing.

Within the framework of the spinning of filaments various treatments such as the preparation and the finishing of yarns by way of yarn processing spinnerets are important stages. The structural change of turning smooth yarns into a textured or interlacing yarn is achieved by mechanical aerodynamic forces. In the former case a flow of air in the supersonic range, in the latter a dual turbulent flow is generated. Air processing spinnerets are utilized to improve the yarn structure. The improvement of quality by means of superheated steam, e.g. the relaxation during the stretch process or after another preceding procedural intervention is a very demanding process.

In all cases, the spinneret elements are produced from a highly wear-resistant material, because their service life would otherwise be too short. The main source of problems for the yarn processing spinnerets lies in the preparation. During preparation, or lubrication, the yarn is fitted with protective substances immediately after the spinning process and/or the production of the individual filaments. These protective substances are intended to be an aid for subsequent processing. The substances used for the preparation provide an oily sliding property which provide the yarn with a lowest possible sliding friction during all the processing steps, reduces the risk of damaging or rupturing the yarn and limits to a minimum the abrasion arising at the sliding surfaces of the transportation and processing devices. There are many other factors which are favorably influenced by the preparation and/or the preparation means such as electric charges. Another field to be mentioned in this respect is the protection against a fungus attack of the yarn during storage between the various processing steps. The factors mentioned offer an impressive idea of the practical environment for the yarn processing elements. The interaction of pressure, heat, moisture, and a variety of chemical substances during the preparation causes very aggressive conditions for the material of the yarn processing spinnerets, above all, however, for any connection means utilized on the spinnerets. The new solution is focused above all on the class of separated and specifically two-piece yarn processing spinnerets with which preferably each part has recesses be it for the yarn canal and/or a processing chamber. When assembled the parts should fit exactly. Moreover, lateral sliding movements of the yarn run should be avoided to facilitate an exact positioning.

REPRESENTATION OF THE INVENTION

The invention is based on the task to develop yarn processing spinnerets and/or yarn processing elements which have a maximum of wear-resistance as regards the preparation and which facilitate a long service life. A special portion of the task was to create a spinneret connection for separated yarn processing element which facilitates a swift and precise positioning and can be used for highly wear-resistant materials such as ceramics including for thermal treatments.

The solution proposed in accordance with the invention is characterized in that the connection of the separated spinnerets presents at least one dowel pin which is contained in at least one part of the element by means of mechanical clamping devices or holding devices and lead in a second part through a corresponding bore for the purpose of positioning and assembly/disassembly of the dowel pin connection in axial direction.

The inventors have discovered that a spinneret with a connection device remains safe to operate only if the spinneret can resist to pressure, heat, steam, or chemical substances. The hitherto known adhesive connections did not represent a satisfactory solution to all problems encountered in practical operations. What is more, a study of an adhesive connection can only be made insofar as practical conditions are actually known at present. However, the composition of an adhesive connection cannot be determined with a view to the exposure to chemical substances unknown today but possibly employed in the future. At best, a statement can be made with respect to exposure to an increased heat or moisture. Preferably, with the new solution, the connection devices are arranged in a common orientation, preferably aligned with the yarn run. Surprisingly it was established that with a corresponding pin connection—as compared with the state of the art—it is possible to substantially reduce the size of the entire spinneret element and have them built quasi in a miniaturized form. Specifically if a dual spinneret is used or if several spinnerets are arranged in parallel, the separation between two adjacent yarn runs can be essentially smaller than before; in some applications this even had repercussions on the size of the galette. Owing to the new connection, the possible miniaturization allows the implementation of additional yarn runs for each individual machine size, and, correspondingly, an increase of the overall performance of the machine. This means that the connection device as an assembly/disassembly aid—otherwise rather known from the watch and clock engineering—and the line-shaped application offers unexpected advantages. The frictional connection of the elements can be ensured—just as with the state of the art—by means of a classical screw connection. Specifically when used as an interlacing spinneret and as a thermal treatment element and also—this will yet be shown—as a migration spinneret, the new solution is very advantageous.

The invention comes with a variety of especially advantageous designs. In this respect, reference is made to claims 2 through 12. In accordance with one specifically preferred solution, two dowel pins are used with two parts to be joined. For this purpose, two essentially identical alignment bores are fitted on the one hand, and one alignment bore and one slot alignment bore on the other. It is taken into account, that the highly wear-resistant materials—above all ceramics—are not only very difficult to process, but also present a different dilatation under temperature changes as compared to metal products. The clamping device or the holding device for the dowel pins can be either a tension spring or an open straining ring. For this purpose it is proposed to fit the dowel pins with a groove for one corresponding straining ring each so that the straining ring's diameter can be reduced during assembly and disassembly of the dowel pins by means of an external dynamic effect. Instead of using a tension spring it is also possible to provide one section of the pins joltable e.g. by different solidity so that a mechanical jolt can be used instead of a tension spring within a bore increase. Preferably the dowel pins are miniaturized in their diameter, and/or provided in a needle-shape. Primarily, the dowel pin has a positioning function. For the positioning, the dowel pin's dimension must only be sufficiently strong so that the pin cannot be damaged during the assembly of the parts, since during the yarn processing there is barely any force exerted on the pins. The frictional connection is preferably provided by means of a screw connection. In accordance with another embodiment an entering cone for longitudinal positioning is fitted on the spinneret element with which the dowel pin is held with the clamping devices. The cone leads over to an after-body and/or a bore increase for the clamping device and/or a straining ring as a holding shoulder. The new solution is perfectly suited when it comes to periodic cleaning which is often carried out by means of ultrasound.

In the two-piece design the processing element is provided as a spinneret plate and a cover plate whereby the dowel pins can be fixed in the spinneret plate preferably rotatable by means of the clamping device. For this purpose the cover plate is fitted with a pocket bore or a through bore with a slightly enlarged diameter at the end of the bore and an alignment bore for the dowel pin in the insertion bore part. It is specifically preferred to have the connection provided with two dowel pins which even when assembled have a very small play inside the alignment bore so that the dowel pins remain rotatable at least theoretically. Moreover it is possible to arrange the dowel pins slightly protruding from one side of a spinneret element so that the spinneret element can be plugged into a base plate like LEGO blocks in any preferred number. The use of two dowel pins has the tremendous advantage that as regards the positioning the connection is geometrically accurate or within a narrow tolerance range. If only one dowel pin is used this result can be obtained if the screw connection itself is fitted with an aligning shoulder. If more than two dowel pins are used this can cause disadvantages related to the problems of dilatation and accuracy in production. This means that with extreme thermal strain, two dowel pins are deliberately preferred. If there is no or only a moderate thermal strain two or more dowel pins can be utilized. In the huge majority of applications at least one spinneret part, preferably, however, both spinneret parts is/are made of a ceramic material and the dowel pins are made of high-tensile steel or ceramics. The invention also relates to the utilization of the yarn processing device. Insofar reference is made to claims 13 and 14. If mechanical clamping devices are envisaged for the pins on both sides, the clamping effect on one side shall be markedly smaller than on the other so that the pin will remain in a defined part.

BRIEF DESCRIPTION OF THE INVENTION

Figure 1B:
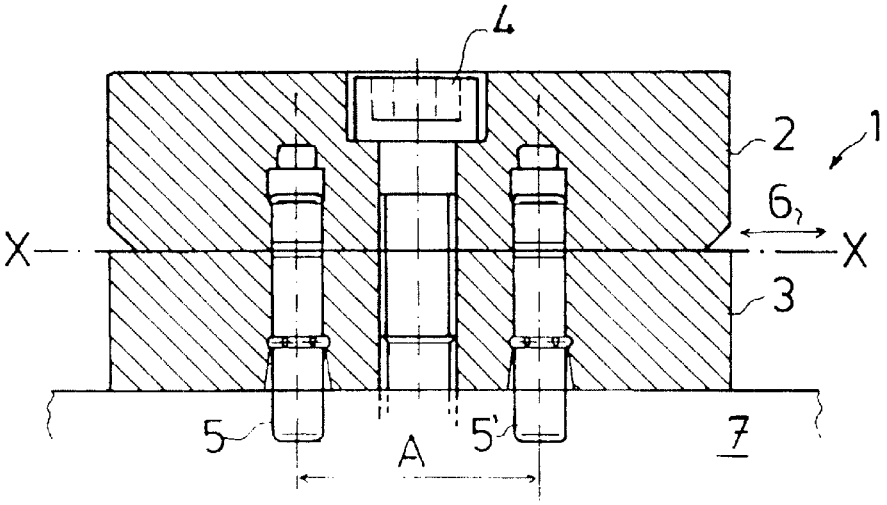
Figure 2A:
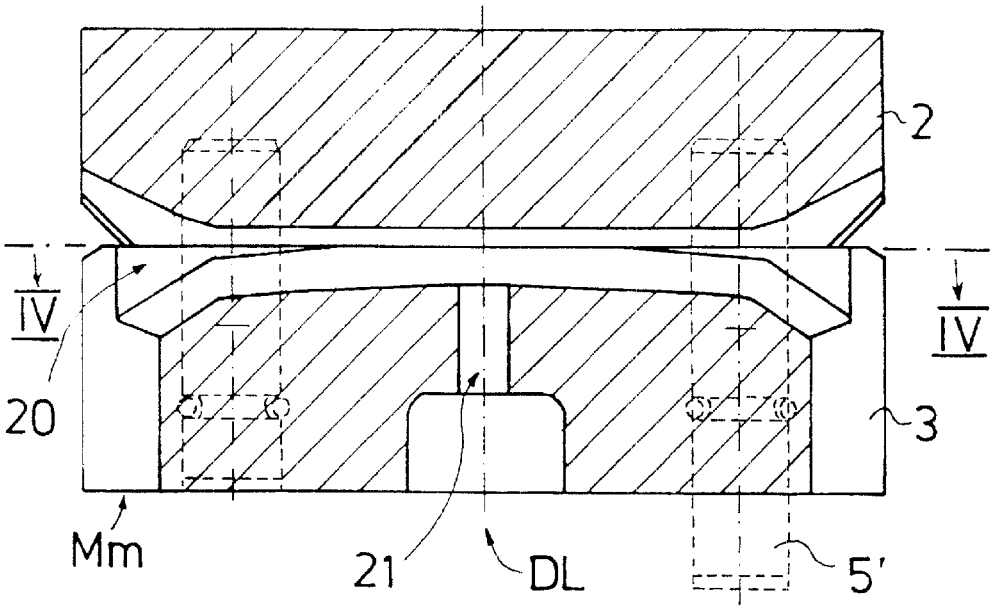
Figure 2B:
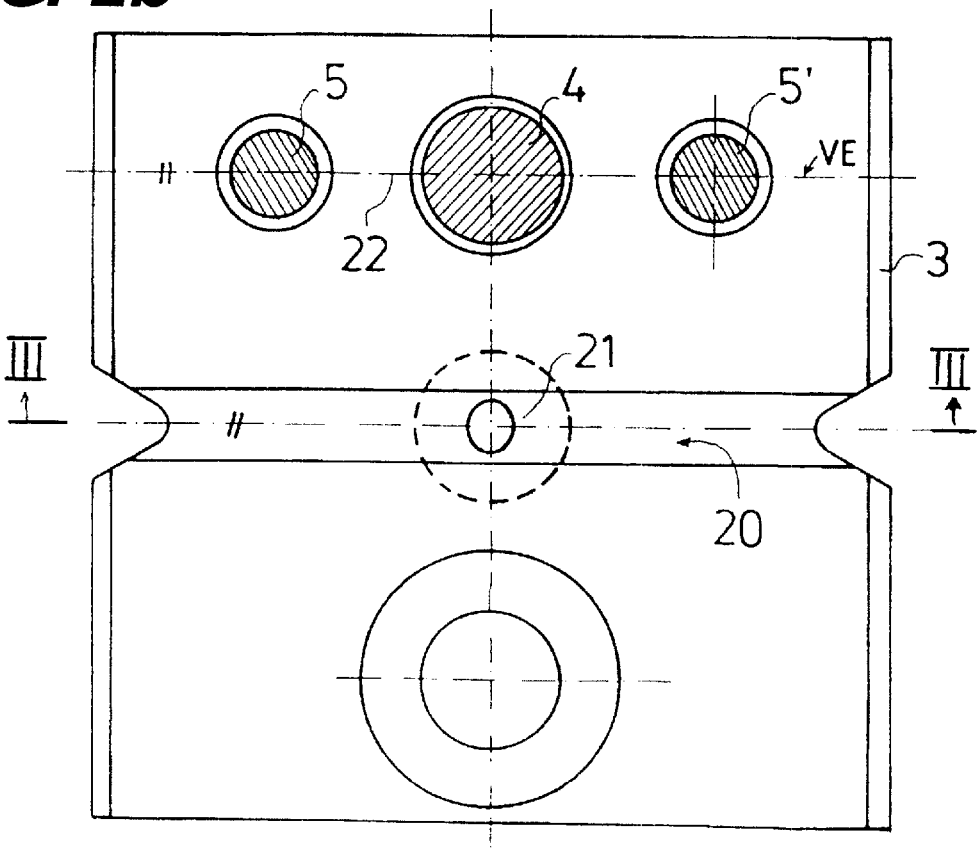

Further details pertaining to the new solution are explained in the following by means of several embodiments of the invention. The magnified figures depict the following:

FIG. 1*a* an exploded perspective view of a section of a yarn processing element, and FIG. 1*b* FIG. 1 as an assembled unit;

FIG. 2*a* a sectional view of an interlacing spinneret taken along III—III of FIG. 2*b;*

FIG. 2*b* a sectional view taken along IV—IV of FIG. 2*a;*

Figure 3:
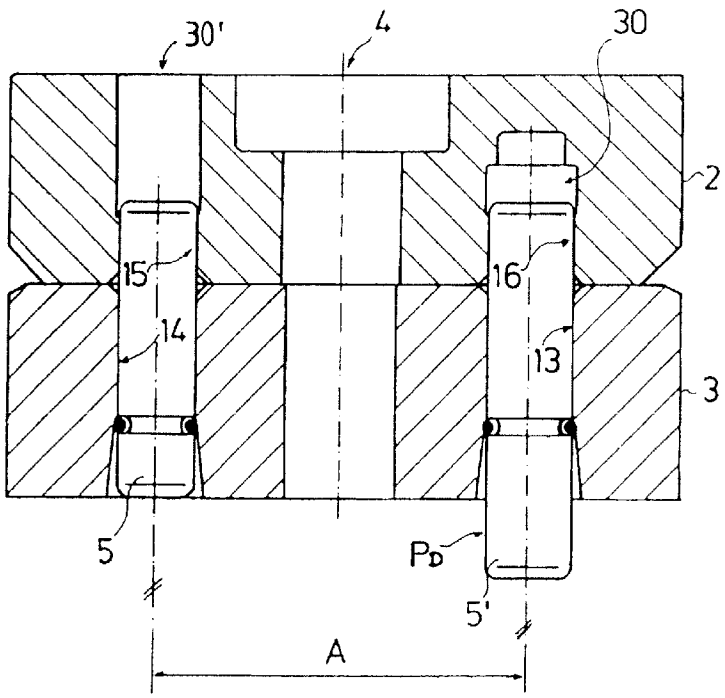
Figure 4A:
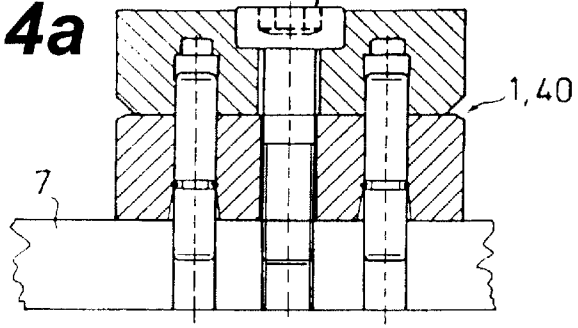
Figure 4B:
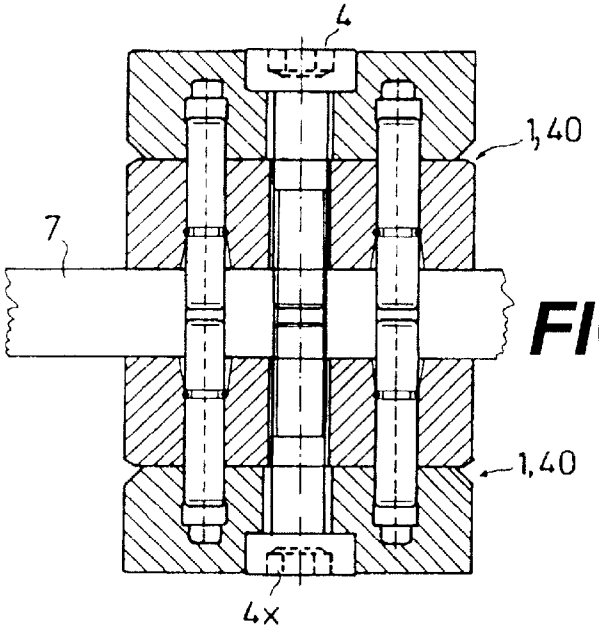
Figure 5A:
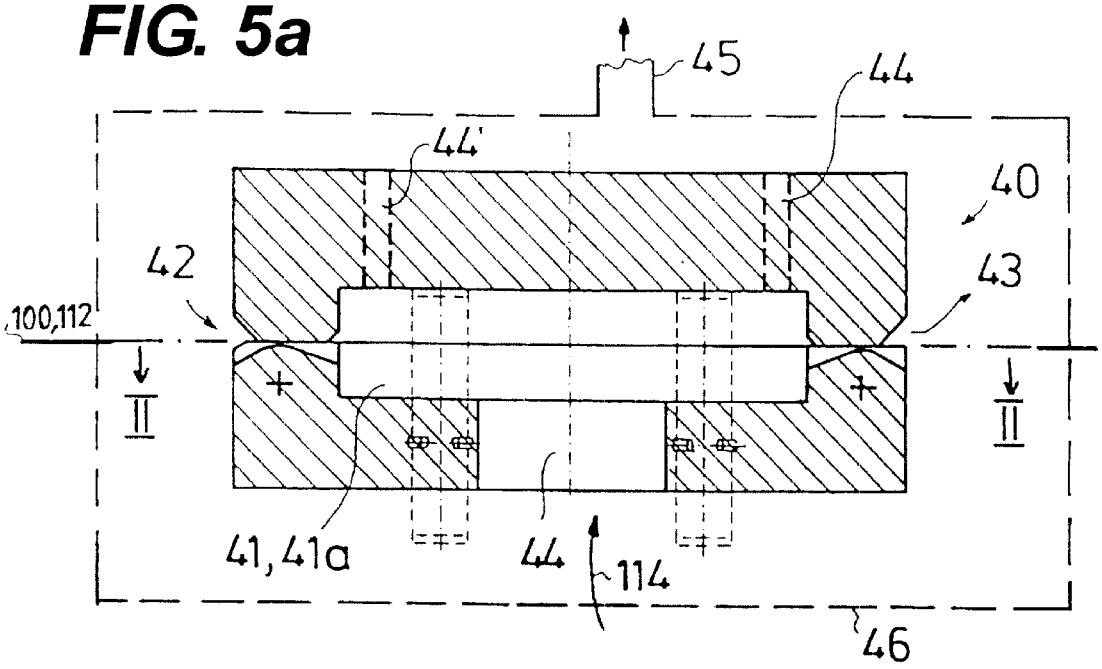
Figure 5B:
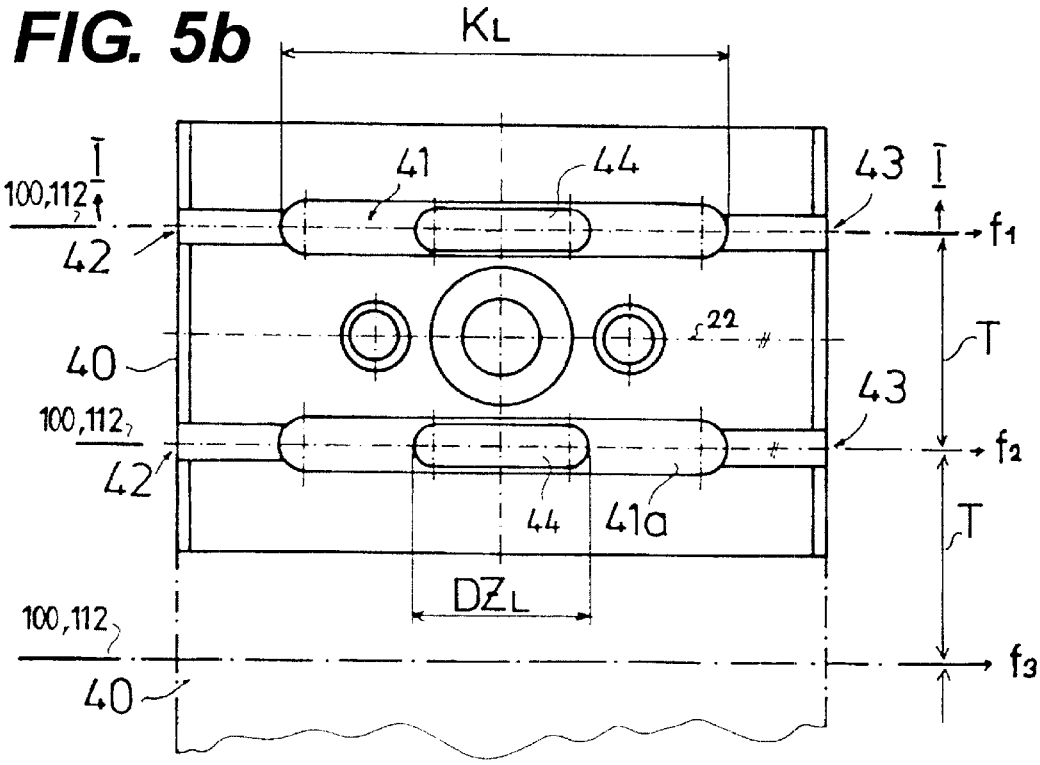

FIG. 3 an arrangement with various dowel pins and bores;

FIG. 4*a* the use of the pin connection also for the machine rack;

FIG. 4*b* another option for the arrangement;

FIG. 5*a* a sectional view of a steam treatment spinneret taken along I—I of FIG. 5*b;*

FIG. 5*b* a sectional view of a dual spinneret with steam chambers taken along II—II of FIG. 5*a;*

FIG. 6 an overview of the various process steps;

FIG. 7 a preparation with attached migration spinneret, each in a sectional view.

APPROACH AND REALIZATION OF THE INVENTION

FIGS. 1*a* and 1*b* each depict a sectional view of a two-piece air treatment element 1; FIG. 1*a* offers an "exploded" view. The processing element consists of a spinneret plate 3 and a cover plate 2. Both parts can be connected rigidly by means of a bolt 4 to form the air treatment element 1 (FIG. 1*b*). For an exact positioning, specifically as an aid during assembly/disassembly, the spinneret plate 3 and the cover plate 2 are secured with two dowel pins 5, 5' against in-plane shifting (in FIG. 1*b* designated with X—X) in accordance with arrow 8. In the example shown the depicted dowel pins 5, 5' have a dual function. Besides serving for the positioning and aligning of the spinneret plate and the cover plate they also assure the local mounting of the entire air treatment spinneret 1 to a processing machine 7 (which is not represented).

Already at the manufacturer the dowel pins 5, 5' are mounted to one of the spinneret parts. In this context it is important that no adhesive connection or welded or soldered joint is used, but that the mechanical clamping device provides the anchoring inside the material of the air treatment element. Lv designates the air treatment side of both parts; Mm designates the machine assembly side. The dowel pins 5, 5' have one alignment shaft 8 and an insertion end 9. A tension spring and/or a straining ring 10 represent the mechanical clamping means. For the straining ring 10 an after-body 11—by and large similar in shape to the straining means—is fitted in the spinneret plate 3 next to an insertion cone 12. The insertion cone 12 facilitates the automatic assembly of the dowel pins. The spinneret plate 3 has two alignment bores 13. The dowel pin 5 can also be introduced manually into the through bore 14 until the straining ring 10 comes against the narrow part of the insertion cone. The remaining movement for the insertion of the dowel pin 5 can be provided by a light blow e.g. with a rubber mallet so that the tension spring 10 springs into the after-body. In the fully assembled state, the dowel pin 5 protrudes on both sides which is designated with Po (positioning of the spinneret parts) and PM (positioning of the machine). The counterpart of the spinneret plate 3 is the cover plate 2 which has two axially parallel alignment bores 15 and 16 with an identical clearance A. The alignment bore 15 can be a normal cylindrical bore with a diameter D. The other, however, is provided preferably as a slot DL with a little axial play toward the dimension A for the extension of the body when heat is employed. The assembly of both parts 2, 3 is initially performed at the manufacturer. In practical use, for cleaning the parts, the bolt 4 will be released and the parts will be detached in axial direction of the dowel pins. Another important advantage of the proposed solution lies in the fact that subsequent recycling is facilitated since parts can be separated easily and the different materials can be recycled separately. This is all the more important since the yarn processing spinnerets are wearing parts.

FIGS. 2*a* and 2*b* illustrate a specific form of a yarn canal 20 for the swirl of yarn using pressurized air or another medium. DL marks the spot envisaged for the pressurized air connection whereby the pressurized air will be introduced into the yarn canal 20 via a pressurized air inlet bore 21 at a pressure between e.g. 1 and 6 bar. It is preferred that both dowel pins 5, 5' are arranged on a common straight line (VE) together with bolt 4. This renders both an optimal dowel connection and frictional connection, and it facilitates a narrow separation for the yarn run (as is illustrated in FIG. 5*b*).

FIG. 3 illustrates another possible embodiment for the pin connection. On the right side of the figure, the protrusion of the dowel pin 5' in accordance with FIG. 1 is indicated. The alignment bore 16 ends with a blind hole 30 which is used for a defined embodiment of the alignment bore 15. On the left side of the figure the dowel pin 5 is provided flush with the corresponding spinneret part in the area of the insertion spot as a second variant. Instead of a blind hole 30 a through hole 30' has been drilled. Depending on the requirement the one or the other or both can be used on the same spinneret. The shown variations illustrate another immense advantage. The two base elements of the yarn processing spinnerets are made of a highly wear-resistant and very expensive material specifically ceramics. The bores and/or seats for the clamping devices can be produced. With a standard and/or automated method as regards diameter and diameter relations. The dowel pins, however, can be manufactured as cheap decoltage parts in various lengths for the respective applications.

FIG. 4*a* illustrates the positioning of a two-piece spinneret element 1 and/or 40 as well as the local fixation onto a machine 7. FIG. 4*b* depicts an example of how two yarn processing elements 1 and/or 40 can be mounted laterally reversed onto a base support 7.

FIGS. 5*a* and 5*b* illustrate a thermal treatment element 40 which has two flow chambers 41, 41*a* specifically for the processing of yarn with superheated steam or hot air. Each flow chamber has one yarn inlet 42 and one yarn outlet 43 as well as a medium feed opening 44 in the center. If the medium is superheated steam a disadvantage of extremely aggressive conditions for the yarn arises due to the very high yarn transportation speed used in these days in conjunction with the preparation of the yarn. The very interesting aspect of the shown example lies in the fact that both flow chambers and/or steam chambers have a remarkably large longitudinal dimension KL which is due to the working process and/or must be determined on a case by case basis. As can be seen in FIG. 5*b*, the yarn processing element 40 does not only have one but two flow chambers 41 and 41*a*. With the new embodiment of the connection devices both chambers may be built with a very small distance between them. If many yarn runs are required this is particularly advantageous because the partition T between two adjacent yarn runs can be extremely small. The dowel pin and screw connection is preferably fitted along a line 22 in parallel with the yarn run. In FIG. 5*b* an additional yarn processing spinneret is indicated by a dotted line whereby f1, f2, f3 mark one thread run each. The shown processing element 40 is depicted symmetrically so that the direction of the thread run is irrelevant. The medium introduced by the feed opening 44 can exit the flow steam chamber via the yarn inlet 42 and the yarn outlet 43. If only a single steam treatment position is used the amount of steam is rather small and can escape into the room. If, however, multiple steam treatment positions are used in the same room, the superheated steam from the flow chamber 41, 41*a* must be collected and evacuated. This can be facilitated by steam outlet bores 44, 44' and by a steam collection line 45. Advantageously one or several positions will be encompassed by a common steam collection housing 46. The flow of the medium into the flow chamber but also out of the flow chamber is a very important aspect. The characteristic feature of a classic yarn processing spinneret is that the pressurized air is bundled into a strong air jet and introduced into the yarn canal, thereby generating a very specific current. The situation with the new thermal treatment element is completely different since it seeks to avoid a jet effect. In FIG. 5*b* the chamber length is indicated by KL and the length of the medium inlet opening 44 by DZL. In the illustrated example the length DZL corresponds to more than one third of the length KL. The steam can also be introduced via several bores. It is important during the thermal treatment to avoid any directed jet effect of the thermal medium be it hot air, superheated steam or another hot medium mixture which may e.g. contain a preparation substance.

The following discussion will relate to FIG. 6 which shows an overview of various processing steps. On the left side of the drawing from top to bottom a texturing process is depicted and to the right a swirl process is shown. As regards the texturing process, WO97/30200 is referenced. Smooth yarn 100 is introduced into a texturing spinneret 101 and then into the yarn canal 104 from the top via a first feed station LW1 at a high transportation speed V1. Highly compressed air is blown into the yarn canal 104 at an angle to and in the direction of the transportation of the yarn via pressurized air canals 103 which are connected to the pressurized air source PL. Immediately adjacent, the yarn canal 104 is conically opened such that a supersonic current preferably at above Mach 2 is provided at the conical section 102. As extensively described in WO97/302000 the shock waves generate the actual texturing. The first section from the air inlet station 105 into the yarn canal 104 through to the first section of the conical expansion 102 serves to loosen and open up the smooth yarn such that the individual filaments are exposed to the supersonic current. The texturing takes place either still inside the conical part 102 or in the outlet area depending on the power of the available air pressure (9 . . . 12 through 14 bar or more).

There is a direct proportionality between Mach number and texturing. The higher the Mach number the stronger the shock effect and the more intensive the texturing. For the production rate there are two critical parameters: first the desired quality standard, and second the flapping which will cause the texturing to disappear when the transport rate is further increased.

Th. Vor. stands for the thermal pre-treatment possibly exclusively for the purpose of heating the yarn.

G. mech stands for the processing of the yarn using the mechanical effect of a pressurized air current (supersonic current).

Th. Nach stands for thermal after-treatment using superheated steam (possibly only heat and/or hot air).

FIG. 7 depicts a section of a yarn processing process; the chemical preparation is shown on the left side, the migration on the right side. The yarn 100' is introduced directly from the spinning process and is guided through a preparation device 120 which consists of a base element 121 into which a feed canal 122 for the preparation substance is introduced from the bottom up to the area of the thread run and which ends with the so-called preparation lips 123. U-shaped guide links 124 are arranged above the preparation lips guiding the yarn 100' laterally over the preparation lips 123. The base element 121 preferably has a convex guide groove 125 such that the thread run is gently but firmly guided over the spot where the yarn 100' has contact with the preparation substance. The application of the preparation substance onto the yarn takes place like an entraining effect. As in the feed canal 122 the preparation substance is only under a limited pressure resulting from the fact that a continuous flow is assured, it is impossible to wet all the filaments of the yarn evenly. Consequently the preparation substances cannot be applied sufficiently homogenous to the yarn on the preparation lips. Depending on the type of the preparation substance the preparation film having been applied partly only to one side will dry soon such that functionality will remain reduced. It has been found by the inventors that this problem can be remedied by subjecting the yarn 100' to an intensive air whirl current shortly after the preparation in a distance FA. A dual whirl current has proven to be optimal as this current will generate a perfect mixing of the preparation substance in the entire yarn system and, simultaneously a crossing of the filaments within the treads. Generally, in this process whirl knots shall be avoided. As regards whirling, the migration spinneret does only achieve half the job. The yarn is opened up by the dual whirl current and the individual filaments are crossed against each other.

What is claimed is:

1. A yarn processing device comprising:

a first processing element portion and a second processing element portion configured to be connected together to form a yarn processing element, the first and second processing element portions being made of a wear resistant material;

a screw-type connection mechanism for connecting the first processing element portion to the second processing element portion;

at least one dowel pin configured to be received in an alignment bore defined by the second processing element portion; and a mechanical retention mechanism configured to maintain the at least one dowel pin in position relative to the first processing element portion.

2. The yarn processing device of claim 1, further comprising two dowel pins disposed axially parallel to each other.

3. The yarn processing device of claim 1, wherein the yarn processing element defines a thread run, and wherein the screw-type connection and the at least one dowel pin are disposed parallel to the thread run.

4. The yarn processing device of claim 1, wherein the first processing element portion defines another bore having substantially the same diameter as the alignment bore defined by the second processing element portion.

5. The yarn processing device of claim 4, wherein the second processing element portion is a spinneret element which further defines a slot bore for receiving a second dowel pin.

6. The yarn processing device of claim 1, wherein the alignment bore is a slot bore.

7. The yarn processing device of claim 1, wherein the mechanical retention mechanism includes one of a straining ring and a tension spring associated with the at least one dowel pin.

8. The yarn processing device of claim 7, wherein the at least one dowel pin defines a groove configured to receive one of the straining ring and the tension spring.

9. The yarn processing device of claim 7, wherein the diameter of the one of the straining ring and the tension spring is reducible in response to an externally applied force during positioning of the at least one dowel pin relative to the first processing element portion.

10. The yarn processing device of claim 7, wherein the retention mechanism further comprises an after-body associated with the first processing element portion.

11. The yarn processing device of claim 10, further comprising an insertion cone leading to the after-body such that one of the straining ring and the tension spring passes through the insertion cone to be placed in the after-body.

12. The yarn processing device of claim 1, wherein at least one dowel pin is fixed by the mechanical retention mechanism to the first processing element portion so as to inhibit the rotation of the at least one dowel pin relative to the first processing element portion.

13. The yarn processing device of claim 1, wherein the second processing element portion defines a second bore and the diameter of the second bore is larger than the diameter of the alignment bore as measured at an end into which a dowel pin is configured to be inserted.

14. The yarn processing device of claim 1, wherein the at least one dowel pin protrudes from at least one side of the first processing element portion when it is maintained in position relative to the first processing element portion.

15. The yarn processing device of claim 1, wherein the first processing element portion, the second processing element portion, and the at least one dowel pin are made of ceramic material.

16. The yarn processing device of claim 1, wherein the first processing element portion and the second processing element portion are made of ceramic material, and the at least on dowel pin is made of high-tensile steel.

17. The yarn processing device of claim 1, wherein the yarn processing element defines a flow chamber having a yarn inlet and a yarn outlet, and further comprising a treatment medium feed canal in flow communication with the flow chamber.

18. The yarn processing device of claim 17, wherein the treatment medium feed canal is in flow communication with the flow chamber via a slot bore on the yarn processing element.

19. The yarn processing device of claim 18, wherein the length of the slot bore is at least 20 percent of the length of the flow chamber.

20. The yarn processing device of claim 17, wherein the processing element is in the form of a dual spinneret defining two parallel flow chambers, each having a yarn inlet and a yarn outlet, the flow chambers being formed by symmetrical chamber halves in the first and second processing elements.

21. The yarn processing device of claim 1, wherein the processing element is in the form of a dual spinneret defining two parallel flow chambers, each having a yarn inlet and a yarn outlet, the flow chambers being formed by symmetrical chamber halves in the first and second processing elements.

22. The yarn processing device of claim 1, wherein the at least one dowel pin has a tapered portion.

23. The yarn processing device of claim 1, wherein the at least one dowel pin has a miniaturized diameter.

24. The yarn processing device of claim 1, wherein the first processing element portion comprises a spinneret plate.

25. The yarn processing device of claim 24, wherein the second processing element portion comprises a cover plate.

26. The yarn processing device of claim 1, wherein the second processing element portion comprises a cover plate.

27. The yarn processing device of claim 1, wherein at least one of the first and second processing element portions are made of ceramic material.

28. A method of treating yarn comprising:

providing the yarn processing device of claim 1;

treating the yarn via one of an air treatment spinneret and a yarn swirl spinneret; and thermally treating the yarn with a hot gas medium via the yarn processing device.

29. The method of claim 28, wherein the hot gas medium is superheated steam.

30. A method of treating yarn comprising:

providing the yarn processing device of claim 17;

either texturing or swirling the yarn via an air treatment spinneret; and thermally treating the yarn via the flow chamber.

31. The method of claim 30 wherein the yarn is thermally treated with steam in the flow chamber.

32. A method of treating yarn comprising:

providing the yarn processing device of claim 1;

chemically preparing the yarn; and subjecting the yarn to an air whirl current via the yarn processing device.

* * * * *